United States Patent [19]

Chen

[11] Patent Number: 5,004,931

[45] Date of Patent: Apr. 2, 1991

[54] CENTRAL LOCK CONTROL SYSTEM ADAPTED FOR AUTOMOBILE

[75] Inventor: Michael Chen, Taipei, Taiwan

[73] Assignee: Advance Security Inc., Taipei, Taiwan

[21] Appl. No.: 424,040

[22] Filed: Oct. 19, 1989

[51] Int. Cl.[5] ..... E05B 47/00

[52] U.S. Cl. ..... 307/10.2; 361/170; 70/264; 70/279; 180/289

[58] Field of Search ..... 361/170–172, 361/160, 189, 191–193; 307/10.1–10.5; 70/264, 275–283; 292/144, 201, 336.3, DIG. 3, DIG. 4, DIG. 23, DIG. 25; 180/287, 289; 340/825.31

[56] References Cited

U.S. PATENT DOCUMENTS 4,425,597 1/1984 Schramm ..... 361/172

*Primary Examiner*—A. D. Pellinen
*Assistant Examiner*—David Osborn
*Attorney, Agent, or Firm*—Browdy and Neimark

[57] ABSTRACT

An improved central lock control system adapted for automatically locking and unlocking all the four doors by way of operation on the lock knobs mounted on the two front doors, and only permitting to automatically unlock all the four doors by way of operation on the lock knobs mounted on the two rear doors for safety consideration; the present lock control system is characterized in that the motor, used to control the motion of an actuator which enables the lock knobs of the doors to perform the locking and unlocking operation, is able to spin clockwise or counter clockwise to generate an inductive voltage on the lock knob being pulled up to unlock or pushed down to lock the doors; the generated inductive voltage is input into an electronic module for logic comparison so to effect the above cited control operation; whereby the control circuit is simplified to a large extent and the mounting of the present system is made easy; besides, the production cost is effectively lowered as a result of the removal of a signal switch.

3 Claims, 5 Drawing Sheets

CENTRAL LOCK CONTROL SYSTEM ADAPTED FOR AUTOMOBILE

FIELD OF THE INVENTION

The present invention relates to a central lock control system which permits the four doors of an automobile to be locked or unlocked simultaneously by way of actuation of any of the lock knobs mounted on the two front doors, and permits the four doors only to be unlocked when either of the lock knobs of the rear doors instead of the front doors are actuated.

BACKGROUND OF THE INVENTION

Generally speaking, the lock control systems of the prior art are equipped with a lock acutuator disposed on the door adjacent to the driver's seat whereby the driver can effect the locking and unlocking operation of all the doors of a vehicle at the same time.

As shown in FIG. 1, the actuator 1 is provided at the top end thereof with an engagement ring 11 connected upward to a lock knob by means of an attachment rod and other necessary links. The engagement ring is downward coupled to a rack member 13 disposed within a casing 12. The rack member 13 disposed within a casing 12. The rack member 13 is further extended into an actuation rod 14 at the bottom end thereof. On the engagement ring being depressed to its lowest position, the actuation rod 14 is moved to abut a limiting switch 15. The rack member 13 is in engagement with a gear 16 of a set of coaxially disposed gears. A gear 18 attached to the shaft of a motor 17 is engaged with the largest gear of the gear set so that the actuator 1 can make the engagement ring 11 to move upward or downward by the operation of the motor, resulting in the automatic lift and depression of the lock knob.

In the prior art lock control systems, the limiting switch 15 is only mounted in one of the actuators generally disposed on the front door next to the driver's seat. Therefore, as shown in FIG. 2, the wiring diagram, the actuator 1A has two wires W1, W2 associated with the motor; and two signal wires S1, S2 and a ground line G are coupled to the limiting switch 15. In the meanwhile, the other actuators 1B, 1C, 1D mounted respectively on the other doors. As clearly shown in the same figure, all the actuators are coupled to an electronic module 2, the signal output from the limiting switch 15 is transmitted by way of S1, S2 to the electronic module 2 which effect the control of other actuators 1B, 1C, 1D to perform the same operation.

It is now clearly seen that the prior art lock control system has a relatively complicated wiring connections. Thus, the installation of the system is not easily performed. This constitutes one of the disadvantages of the prior art. Furthermore, only one of the actuator is equipped with the limiting switch such that the doors can be automatically operated by this actuator. If all doors are desired to effect automatic control over the others, each actuator must be installed with an extra limiting switch accordingly, causing the raise of the cost with the wiring becoming more complicated.

Besides, in the prior art lock system only the driver's door is equipped with the limiting-switch operated actuator so that the driver is not able to detect the rear doors being opened by the passengers, especially small children Thus, accidents can be easily caused as a result thereof.

Therefore, the primary object of the present invention is to provide an improved central lock control system which eliminates the disadvantages of the prior art power lock system.

One other object of the present invention is to provide an improved central lock control system which can transform the clockwise or counterclockwise rotation of the motor, produced by the pull or depression of the lock knobs of the front doors, into an inductive voltage signal which is delivered to an electronic module to be amplified, shaped and compared, and actuates a relay to cause the other motors of the actuators to spin clockwise or counterclockwise accordingly.

One still other object of the present invention is to provide an improved central lock control system which is free of the use of a limiting switch so that the installation thereof is made simplified. Besides, the actuation of any lock knobs of the doors can be transformed into signals delivered to an electronic module for effecting the control of other doors.

One still other object of the present invention is to provide an improved central lock control system which is characterized in that the door-locking signal from either of the rear doors is transferred to a semi-automatic circuit, and the signal produced by the motor in locking the rear door is crossed out; only the signal produced by the motor in unlocking the rear door is delivered to the electronical control unit so to simultaneously unlock the other doors. Thus, the driver can notice immediately the rear doors being unlocked by kids sitting in the back seat, and take thereby proper actions small children can be protected in a safer manner from possible accidents.

DETAILED DESCRIPTION OF PREFERRED EMBODIMENT

Figure 1:
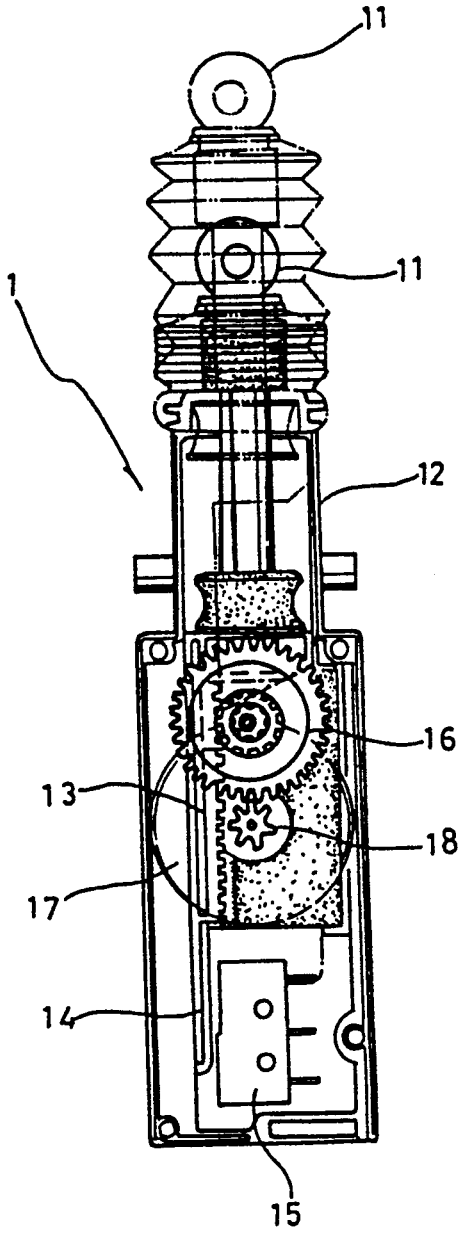
FIG.1 (prior art)
FIG. 1 is a prior art actuator mounted under the lock of an automatic door, the limiting switch 15 thereof has been removed in the present invention.
Figure 2:
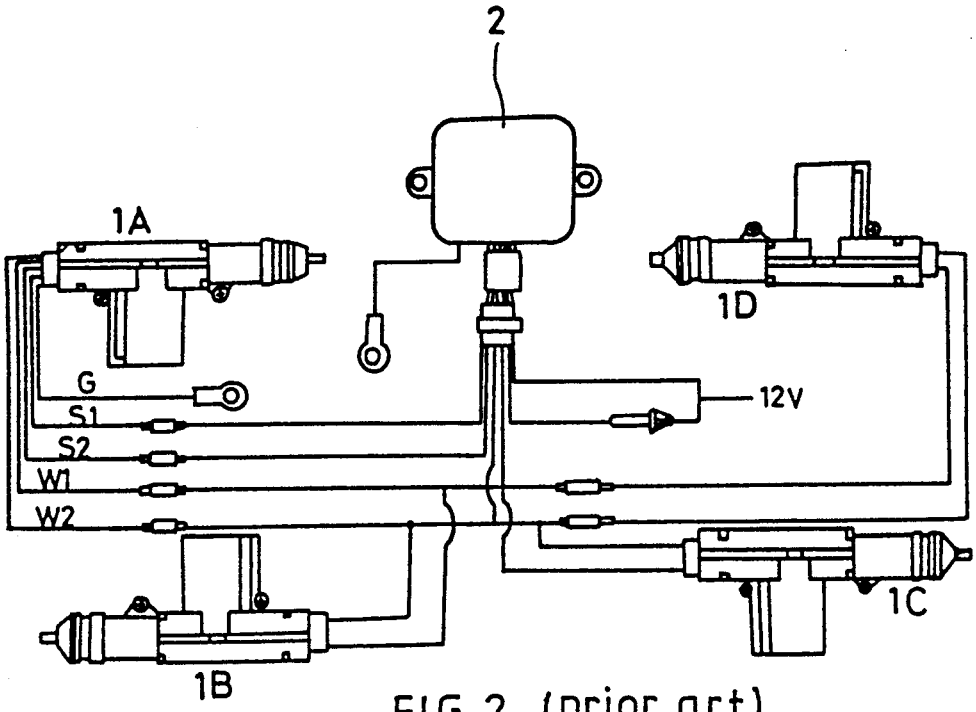
FIG. 2 (prior art)
FIG. 2 is a diagram showing the arrangement of a prior art automatic lock.
Figure 3:
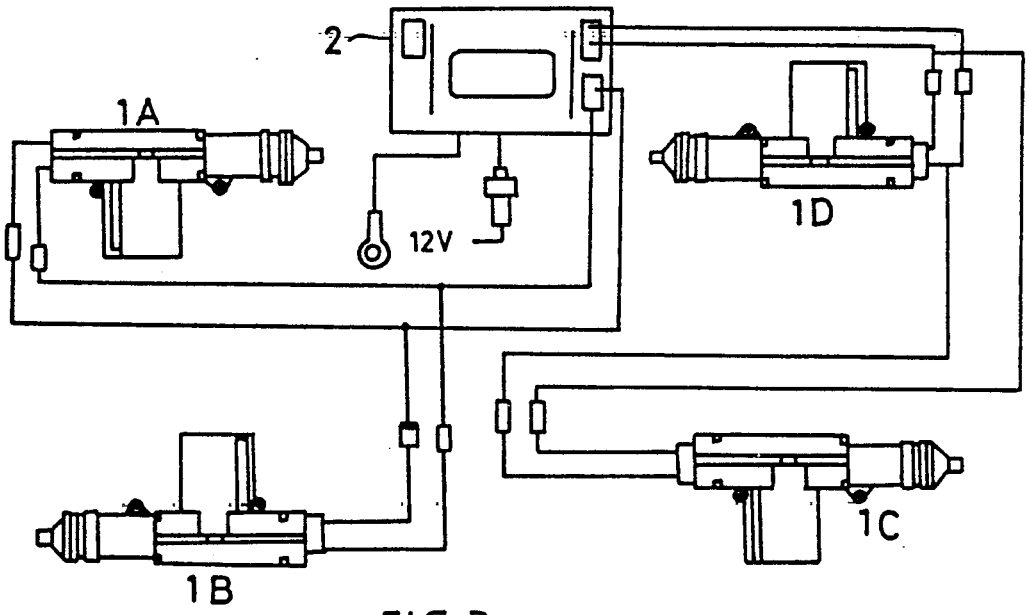
FIG. 3 is a diagram showing the arrangement of the present invention.

Referring to FIG. 1, the prior art power lock system has an actuator which is controlled by a limiting switch 15. In the present invention, the limiting switch 15 is removed, and the motor is coupled directly to an electronic module 2 by electrical cords of the motor, as shown in FIG. 3; wherein the actuators 1A, 1B are employed to control the front doors of the automobile, while the actuators 1C, 1D are for the control of the rear doors thereof. The power of the electronic module is supplied by the 12V DC battery of the automobile.

Figure 4:
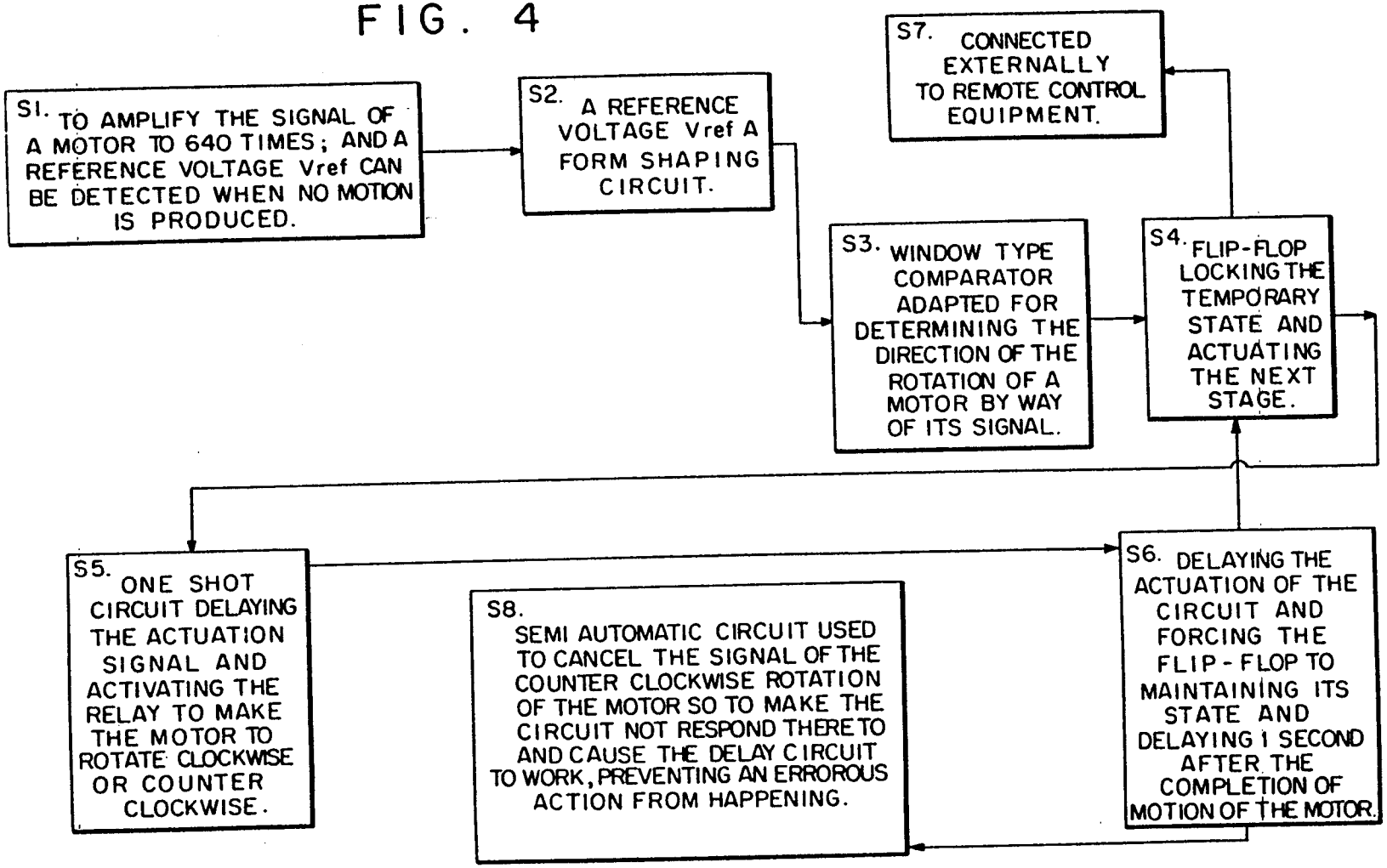
FIG. 4 is a diagram showing the flow chart of the logic process of the present invention.
Figure 5:
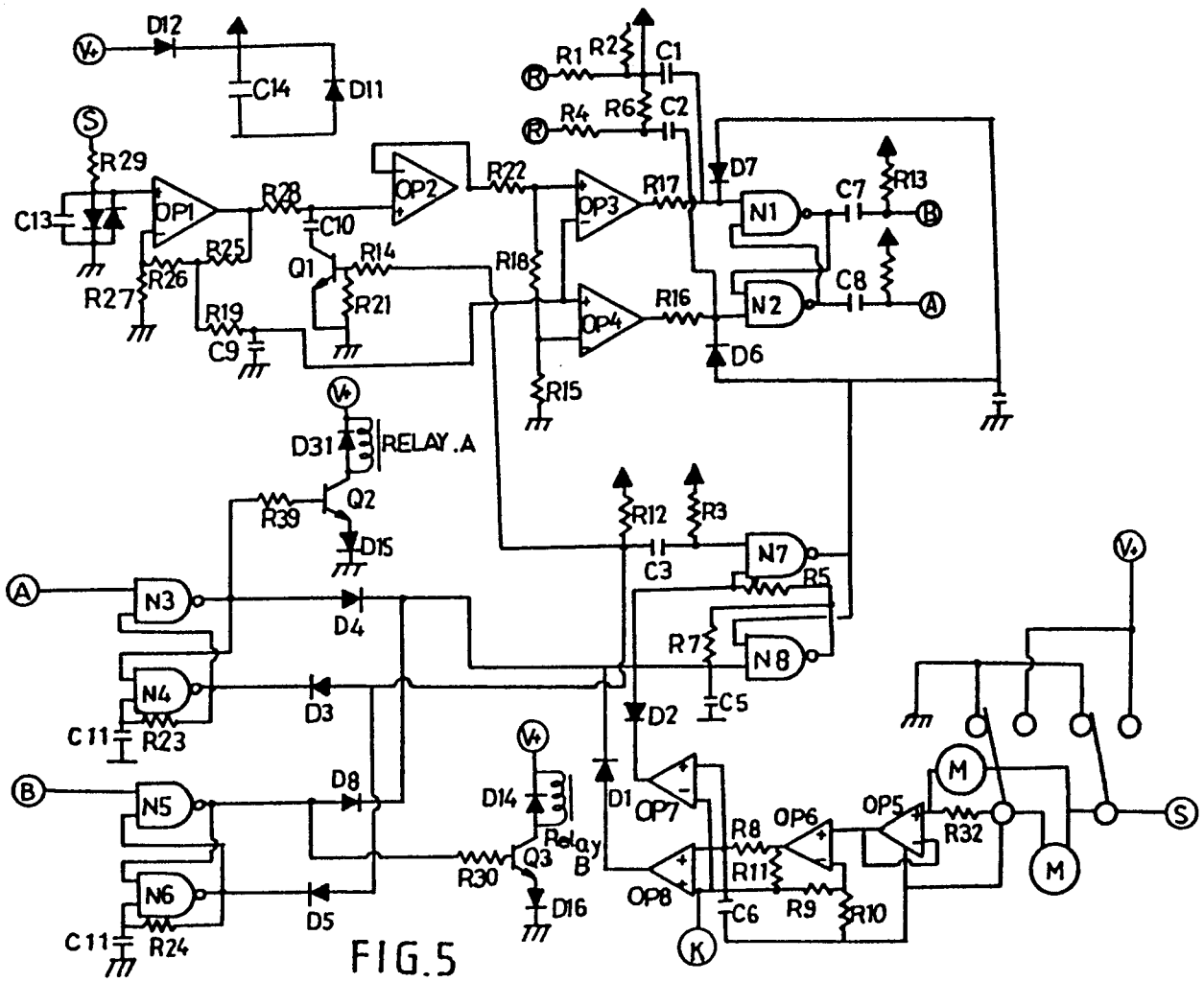
FIG. 5 is a circuit of the electronic module of the present invention.

As shown in FIGS. 4, 5, the logic flow chart and the circuit of the electronic module 2 are illustrated, wherein the portion S1 uses an emitter-follower amplifier OP1 to amplify the motor's signals and is able to detect a reference potential V as the motor is not in operation. The establishment of the reference potential is given as below; end S is the input terminal of the motor operation signal, the motor being either clockwise or counter-clockwise rotated. Normally, the grounded signal has a zero potential, and the first emitter-follower amplifier OP1 generates a positive-phase amplification, and the rate of amplifying is 1+(R25+R26)/R27. The output voltage of the first emitter-follower amplifier is a reference Vref obtained by amplifying the difference between a very small-scale electric current flowing through R29/R27 and the offset of the OP1 itself. The capacitor C13 and the diodes D9, D10 are adapted for prevention of noise and execessive positive, negative bias from entering the "+" terminal of the first emitter-follower amplifier OP1, resulting in a damage to the IC.

In the S2 portion, is disclosed a rectifying circuit for the reference potential Vref wherein the resistor R19 and the capacitor C9 form a RC circuit which is used to detect the ½ Vref transferred to the window-type comparator as defined in the S3 portion. As a result of the capacitance of the capacitor C9 being relatively small and the resistance of the resistor R19 being relatively large, the discharge time for the RC circuit is very short, and provides a floating electrical potential. The resistor R8 and capacitor C10 work to deliver the reference potential Vref, via the rectifying circuit, to the second emitter-follower amplifier OP2 so as to make the reference potential unvulnearable to shift, and the reference potential is divided into two parts by the identical resistors R15, R18 and R22; one is ⅓ Vref, and the other is ⅔ Vref, so as to constitute the window type comparator which is adapted for the detection of the operational direction of the motor.

Figure 6A:
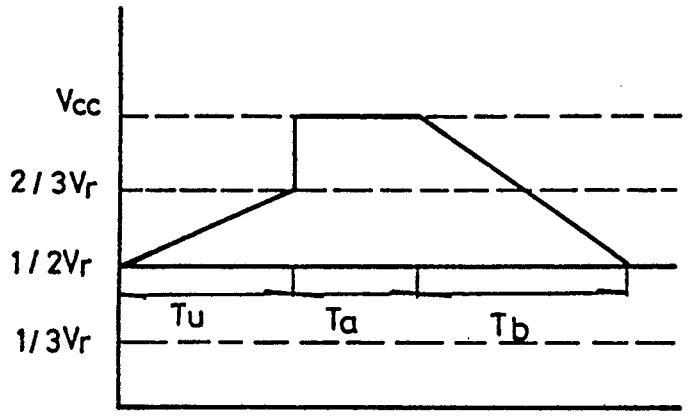
FIG. 6A, 6B are diagrams showing the variations of the signals.
Figure 6B:
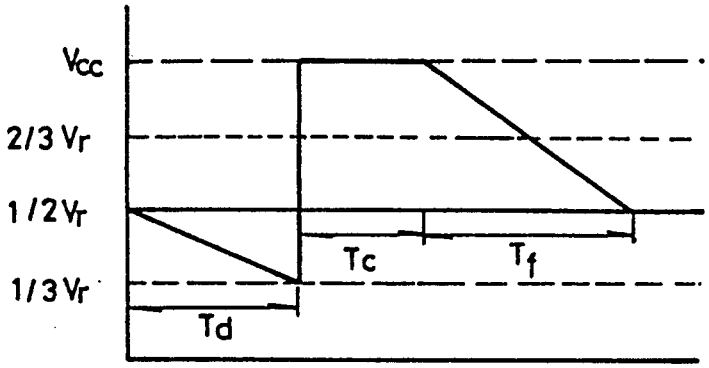

As shown in FIGS. 6A and 6B, the input signals of the motor due to clockwise and counterclockwise rotation are illustrated. It can be clearly shown how the circuit can detect the rotational direction of a motor. Referring to FIG. 6A, when the motor is actuated to rotate counterclockwise as a result of the downward depression of the lock knob, the induced electrical potential will cause a current flowing from the terminal S and R29, R27, then to the ground, thus the gain of the first emitter follower amplifier OP1 is accordingly enlarged. As shown in FIG. 6A, the section Tu indicates the duration of the motor being counterclockwise rotated. In the meanwhile, the potential of the 3rd emitter follower amplifier OP3 turns from a high value to a low value, via a resistor R17, causing the flip-flop made up of the NAND gates N1, N2 (the section S5 in FIG. 5) to actuate the one-shot circuit comprised of the NAND gates N3, N4 (the section S6 in FIG. 5) by way of a capacitor C8; then to activate the second transistor Q2 by way of a resistor R31, resulting in the working of a relay A so as to make all the other electrically associated motors to rotate counterclockwise.

As shown in FIG. 6A, the period Tu indicates the operation time, and the length thereof is determined by the RC circuit consisting of the capacitor C11 and the resistor R23; in the meanwhile, the one shot circuit comprised of the NAND gates N7, N8 is activated by the signal via the capacitor C3, the diode D3, causing the diodes D6, D7 force the flip-flop made up of NAND gates N1, N2, shown in the section S4, to maintain its present state, preventing the emitter follower amplifiers OP3 and OP4 from influencing the flip-flop. The period of such maintaining of the state is effected by the resistor R7 and capacitor C5, and delay is about 1 second. To avoid operational error produced due to electrical charge and discharge processes on the activation of other motors, the first transistor Q1 serves to make the charging and discharging operation in the resistor 28 and capacitor C10 stop. The Ta indicated in FIG. 6A is a period of termination. The diode D4 and capacitor C5 can effect compulsory charge to delay the activation of the NAND gates N7, N8 so as to avoid operational error as a result of overlap of the compulsory charge and the motion of the motors.

Moreover, as shown in FIG. 6B, if the input signal of the motor is caused by clockwise rotation thereof (the pull-up of the lock knob), the electromotive current produced by the motor is flowing in the following direction: from the ground via R27, R29 to S terminal; as a result, the gain of the emitter-follower amplifier OP1 is reduced. As shown in FIG. 6B, Td is the period of time of the motor being actuated as a result of the lock knob being pulled up, in which the voltage of the emitter follower amplifier OP4 changes from high to low; via the resistor R16, the flip-flop consisting of the NAND gates N1, N2 and capacitor C7, the one-shot circuit made up of NAND gates N5, N6, and via resistor R30 and the transistor Q3, the relay B is actuated to produce such a voltage that will get the motor clockwisely rotated; wherein the period of action Td is determined by the transistor R24 and the capacitor C12. In the meanwhile, the one-shot circuit consisting of NAND gates N7, N8 is actuated by a signal transmitted via the diode D5 and the capacitor C3 so as to urge the first and second NAND gates N1 and N2 to maintain in a normal operating status, preventing the effect produced as a result of the state transformation in 3rd and 4th emitter follower amplifiers OP3 and OP4 from taking place; wherein the forced time delay is shown in FIG. 6B as Tc+Tf, which is effected by way of the resistor R7 and capacitor C5.

Furthermore, the diode D5, the resistor R14 and the transistor Q1 terminate the discharge of the resistor R28 and capacitor C10, avoiding the error of the reference voltage Vref caused by the discharge during the actuation of the motor. Tc is the period of termination. A forced charge process is effected by way of the diode D8 and the capacitor C5 so as to get the NAND gates N7, N8 delayed in maintaining the temporary state, avoiding errorous action caused as a result of the repetition of the forced delay time and the motion of the motor.

In section S8, a semi-automatic circuit is formed, the input signal produced as a result of the actuation of the motor of the actuator mounted on the rear door of the automobile, which actuation can generate an inductive electric voltage as the input signal. The emitter follower amplifier OP5 is related to resistor R32 when the lock knob is pulled upwardly with the positive terminal "+" conected to the ground and amplified at the same time. Because the output voltage of the emitter follower amplifier OP5 can not be totally set to zero, the output voltage of OP5 is amplified by the emitter follower amplifier 0P6, and the magnitude of the amplification is 1+(R9+R11)/R10. A reference voltage Vref is generated by way of the resistor R8 and the capacitor C6.

As the motor is rotated clockwisely (the lock knob of the rear door being pressed down), the differential between the reference voltage Vref and the voltage at the point K makes the emitter follower amplifier OP7 shift from a high voltage state, thus causing the flip-flop consisting of the NAND gates N7, N8 to first suppress the action of delay so as to render the actuations of OP1, OP2, OP3, N1 and N2 invalid; and the emitter follower amplifier OP8 is changed from a low state to a high state, forcing the capacitor C6 to charge via the diode D1; therefore, the repeated quick up and down motions of the lock knob of the rear door make the delayed time of the continuous clockwise rotation of the motor prolonged. When the motor is clockwisely rotated, the signal is not detected by the emitter follower amplifier, therefore the clockwise motion will be responded in the circuit.

The function of the other components in the circuit is given respectively as below:

1. D12, C14, D11 are used to keep the current stable and to prevent the reverse connection of the voltage terminal from damaging the circuit.

2. D15, D16 can protect Q2, Q3 from being burned as a result of reverse connection of the voltage terminal.

3. D31, D14 are used to protect the Q2, Q3 from damage by a reverse voltage of the relay.

4. R12, R3, R2, R6, R13 and R12 are resistors of pull HI.

5. C1R1, C2R4 are external units for remote control, capacitor C4 is used to stablize the NAND gate N7.

I claim:

1. A central lock control system comprising four actuators and an electronic module wherein the actuators are disposed in four doors of an automobile respectively and each actuator is operatively connected to, the lock knob of said individual door wherein the lock knob is locked or unlocked by way of a motor disposed in said actuator respectively actuating racks mechanically engaged with said lock knobs; said electronic module is equipped with a circuit therein adopted for determining clockwise or counter clockwise rotation of said motors so as to lock or unlock said doors; the system is characterized by that said electronic module takes the inductive voltage generated as a result of the actuation of the motor in said actuator by said respective lock knob as an input signal which is then amplified, rectified and used to control the locking or unlocking of other doors.

2. A central lock control system as claimed in claim 1 wherein the output signal of said motor is amplified in positive phase via a first emitter-follower amplifier OP1 and a first resistor with a reference potential produced, which is manipulated by way of a first RC circuit, and ½ reference potential thereof being detected and transferred to a window-type comparator; in the meanwhile, said reference potential is transferred to a second emitter follower amplifier via a second RC circuit and turned into a more stable reference potential; and second, third and fourth identical resistors divide said reference potential into ⅓ Vref and ⅔ Vref and define a window type comparator; in said comparator, a third and fourth emitter follower amplifiers detect the output signal of the motor to determine the direction of rotation of the motor; whereby a first flip-flop consisting of the first and second NAND gates actuates a first one-shot circuit, made up of third and fourth NAND gates by way of a first capacitor; and via first and second transistors a relay is actuated to make said motor rotate in either way; in the meanwhile, a second one-shot circuit made up of fifth and sixth NAND gates is actuated via a diode and a second capacitor so as to force the first flip-flop to retain its temporary state; and further by way of a first transistor the discharge of the first RC circuit is stopped and by means of a third capacitor, a forced charge process is effected so to prolong the state of the second one-shot circuit consisting of the fifth and sixth NAND gates.

3. A central lock control system as claimed in claim 1 wherein a fifth emitter follower amplifier is coupled to a fifth resistor, and when the motor is actuated, a voltage signal with a positive end connected to ground is amplified, and a reference potential is formed by way of a sixth resistor and a fourth capacitor; and on a rear door where the motor is being rotated clockwisely, a second flip-flop is forced by way of a sixth emitter follower amplifier to delay in action so as to stop the other motors, in the meanwhile, a seventh emitter follower amplifier forces the fourth capacitor to charge, permitting a continuous actuation of the motor to prolong the time delay of the system; as said motor is rotated in an opposite direction, an eighth emitter follower amplifier is not able to detect the output signal, thereby when one of the lock knobs of the rear doors is pressed with said motor clockwisely rotated, the rest of the doors do not respond; and when one of the lock knobs is pulled up with said motor rotated counter clockwisely, the other doors are opened simultaneously.

* * * * *